US005775104A

United States Patent [19]

Gardner

[11] Patent Number: 5,775,104

[45] Date of Patent: Jul. 7, 1998

[54] HYDRAULIC APPARATUS FOR ACTUATING A PUNCH FOR A CLUTCH FACING MACHINE

[75] Inventor: Thomas Haley Gardner, Englewood, Ohio

[73] Assignee: General Motors Corporation, Detroit, Mich.

[21] Appl. No.: 618,951

[22] Filed: Mar. 20, 1996

[51] Int. Cl.[6] ..... F15B 7/02

[52] U.S. Cl. ..... 60/539; 60/594

[58] Field of Search ..... 60/325, 539, 594, 60/591

[56] References Cited

U.S. PATENT DOCUMENTS 3,977,192 8/1976 Smirnov et al. ..... 60/543
3,999,477 12/1976 Good et al. ..... 100/53
4,187,762 2/1980 Buzby ..... 60/539 X
5,361,480 11/1994 Gardner et al. ..... 29/467
5,526,738 6/1996 Logan ..... 100/35

*Primary Examiner*—Hoang Nguyen
*Attorney, Agent, or Firm*—Donald F. Scherer

[57] ABSTRACT

A rotary drive unit powers a double-acting cam and a Geneva drive. The cam actuates two double-acting pumps which supply pressurized hydraulic fluid to a double-acting motor. A punch is reciprocated by the motor to punch sectors from a sheet material. The Geneva drive rotates a carrier which is indexed to receive material punched from the sheet. The hydraulic fluid is maintained in the system by a pair of check valves which deliver fluid as required from a pressurized reservoir to the pumps during a low pressure portion of the pumping cycle. Also provided are bleed and fill valves and pressure relieve valves which further assist in filling the system and controlling the maximum system pressure.

3 Claims, 3 Drawing Sheets

HYDRAULIC APPARATUS FOR ACTUATING A PUNCH FOR A CLUTCH FACING MACHINE

TECHNICAL FIELD

This invention relates to hydraulic actuating systems having a reciprocal pump and a reciprocal motor for punching material forms from a sheet.

BACKGROUND OF THE INVENTION

A punching operation is used to form interlocking segments to a clutch facing and place them as annuli in a carrier. Each annulus is bonded to a clutch backing plate. One such apparatus for producing clutch plates using a punching operation is shown in U.S. Pat. No. 5,361,480 issued Nov. 8, 1994, and assigned to the assignee of this application. The actuating mechanisms for this machine is mechanical in nature in that drive belts or shafts connect each of the power components to a power source. While these systems are efficient and work quite well, they tend to limit the placement of the various moving parts, such as the power source, to locations that permit the belts or shafts to be accessible to the driven members.

SUMMARY OF THE INVENTION

It is an object of this invention to provide an improved actuating system having hydraulic components for transferring power.

In one aspect of this invention, a pair of double-acting reciprocal pumps are cam-driven to each provide four pumping cycles per revolution. A double-acting hydraulic motor is driven reciprocally by the hydraulic fluid from the pumps to actuate a punch. The same mechanism which drives the cam also drives a Geneva drive at an increased speed to index a part for receiving the items punched from sheet material by the punch which is actuated by the fluid motor.

DESCRIPTION OF AN EXEMPLARY EMBODIMENT

Figure 1:
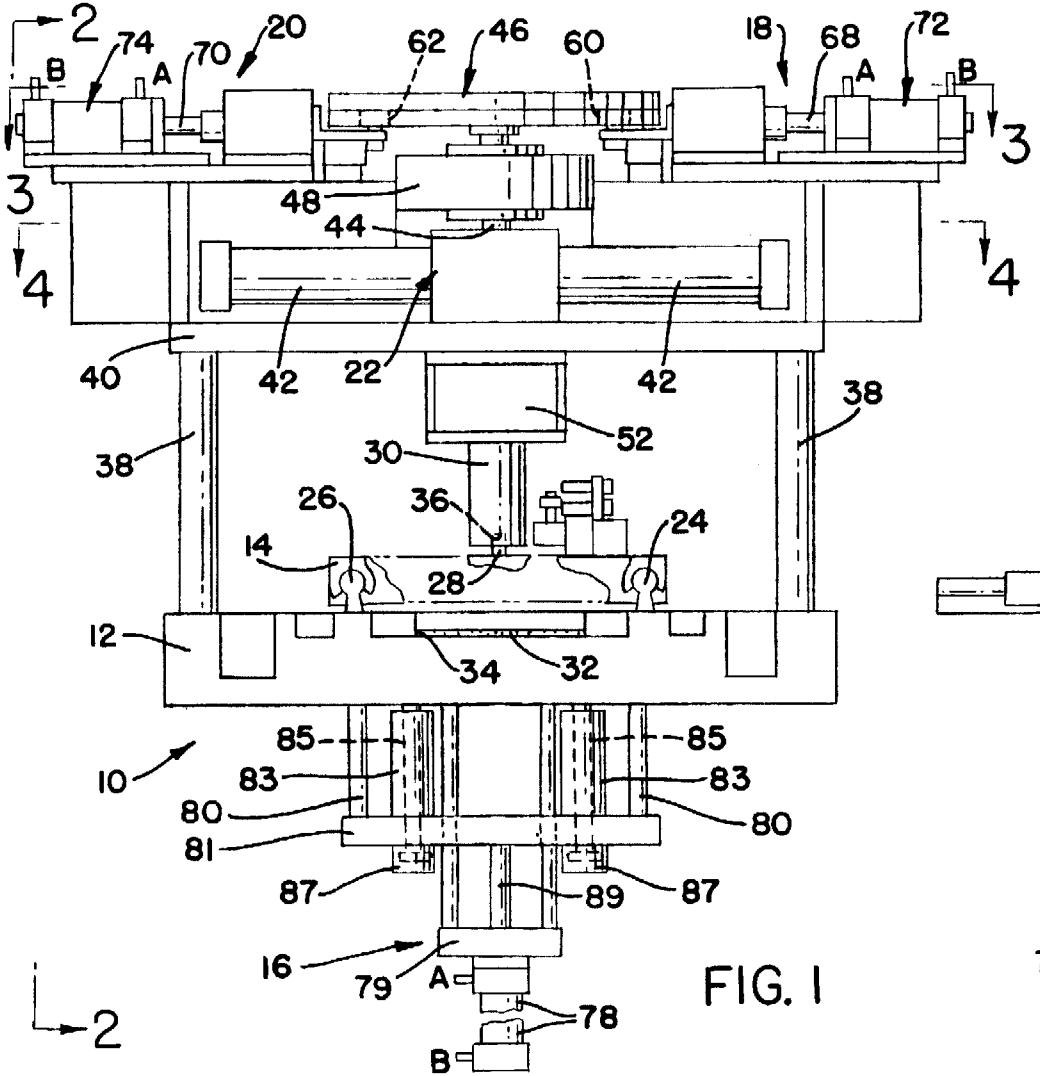
FIG. 1 is an elevational view of a portion of a machine incorporating the present invention.

Referring to the drawings, wherein like characters represent the same or corresponding parts throughout the several views, there is seen in FIG. 1 a punching machine or apparatus 10 comprised of a table platform 12, a movable carriage 14, a punch and motor assembly 16, a pair of pumps 18 and 20, and a power source or unit, generally designated 22.

The table 12 provides a platform for rotatably and reciprocally mounting the carriage 14. The carriage 14 has a portion mounted on rails 24 and 26 for controlled movement in a longitudinal path and a rotary portion, not shown, which has a tang member 28 adapted to be driven by a shaft 30.

The table 12 has a space 34 beneath the carriage 14 in which sheet material 32 is supplied. The carriage 14 is moved longitudinally on the table 12 by a power cylinder, not shown. The movement of the carriage 14 is similar to the longitudinal moving structure of a carriage shown in U.S. Pat. No. 5,361,480. One of the major differences between the carriage assembly 14 of the present invention and that of the above-mentioned patent is the use of the tang member 28. The apparatus in the above-mentioned patent utilizes a spline shaft to rotatably drive the portion of the carriage 14.

The tang member 28 permits the carriage to be moved longitudinally from the punching position shown to a clutch facing position, not shown. The tang remains positioned as shown in FIG. 1, such that the longitudinal movement from the facing station back to the punching station the tang 28 will be aligned with a slot 36 in the shaft 30.

Supported above the table 12 on four posts 38 is a power unit support table 40. The power unit 22 includes a pair of reciprocal motor units 42 which are hydraulically driven by a power source, not shown. The output of the motors 42 rotatably provide for rotation of a shaft 44, which is the power input shaft for a cam 46 and a conventional speed multiplier 48. The speed multiplier 48 has an output shaft 50 which rotates at four times the value of the input speed of shaft 44.

The shaft 50 drives a Geneva drive 52 which provides an intermittent rotary output to the shaft 30. The Geneva drive 52 is a conventional drive unit which will provide one indexing revolution of the shaft 30 for each revolution of the shaft 50. Therefore when the shaft 50 completes four revolutions, the shaft 30 will have been indexed to a complete 360 degrees or a full circle for the clutch making operation.

Figure 3:
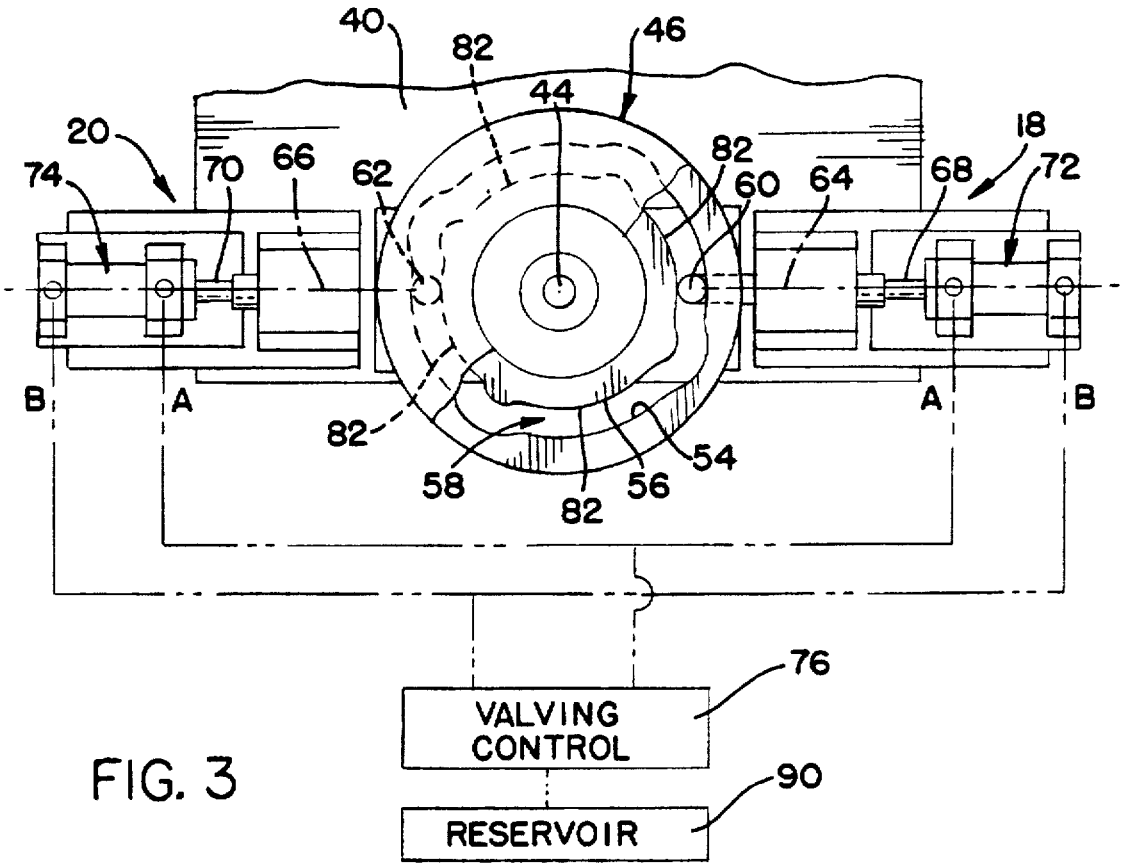
FIG. 3 is a view taken along line 3—3 of FIG. 1.

The cam 46, as best seen in FIG. 3, is driven rotatably by the shaft 44. The cam has an outside cam face 54 and an inside cam face 56. These cam faces are substantially identical in that each provide a rise and fall and dwell at the same angular positions about the shaft 44. The outside face 54 and inside face 56 form a cam track 58 in which a pair of cam followers 60 and 62 are disposed.

As the cam 46 is driven by the power unit 22, the cam followers 60 and 62 are reciprocated along their respective longitudinal axes 64 and 66. The cam followers 60 and 62 are connected with hydraulic pump shafts 68 and 70, respectively. Thus, as the followers 60 and 62 are motivated inwardly and outwardly by the outside cam face 54 and inside cam face 56, the pump shafts 68 and 70 are also reciprocated. Each shaft 68 and 70 has a piston secured thereto and a shaft extension which extends beyond the piston within a piston cylinder, not shown, thereby providing conventional double-acting pumps, generally designated 72 and 74.

As is well known, these types of hydraulic pumps will displace the same volume of hydraulic fluid independent of the reciprocal direction of their respective shafts 68 and 70. Therefore, as the cam followers 60 and 62 drive the shafts 68 and 70 radially outwardly from the cam, fluid under pressure is expelled through the hydraulic conduits or passages B. As the shafts 68 and 70 are drawn radially inwardly to the cam 46 by the outside faces 54, the pumps 72 and 74 displace fluid via the hydraulic conduits or passages A while intaking fluid via the passages B. These passages A and B are connected to a control valve assembly, generally shown schematically at 76.

The hydraulic conduits A and B are also in fluid communication with a hydraulic motor 78 which is secured to a bracket 79 beneath the table 12. The bracket 79 is secured to the table 12 by guide rods 80 on which a platform 81 is slidably supported. The platform 81 is connected with the motor 78 by a piston rod 89 which extends upward through the bracket 79. The hydraulic motor 78 is a double-acting motor and is a component of the punching unit 16. The double-acting hydraulic motor 78 has the same cylinder volume on both sides of its piston, such that with a given amount of fluid, the reciprocation will be the same in both directions. The motor 78 is preferably sized to have a volume on each stroke equal to the stroke volume produced by the combined pumps 72 and 74. Thus, for each stroke of the pump 72 and 74, the motor 78 will make one stroke.

As the pumps 74 displace fluid out the passages B, the motor 78 will displace platform 81 upwardly on the guide rods 80 to cause material in the sheet material 32 to be displaced into the carriage 14 by a punch or cutting die, not shown. The punch is driven upward by rods 83 which are connected with the platform 81. The rods 83 are tubular, such that air spring rods 85 are housed therein.

The air spring rods 85, which are connected with air cylinders 87, provide a cushion between the hydraulic motor 78 and the cutting die. When the cutting die abuts the friction material, the air spring permits a limited amount of compression in the range of one-eighth of an inch. When sufficient force is developed, the friction material will be cut relieving the load on the air spring rods 85, such that the friction material is pushed upwardly under the influence of the air spring rods 85 only.

The hydraulic motor 78 will have reached the maximum stroke thereof prior to the friction material being fully displaced into the carriage 14. This will prevent the carriage 14 from being subjected to the high force output that the hydraulic motor 78 can produce. The force of motor 78 will blank the paper through the die into the carriage 14. The air spring rods 85 will cause further movement of the blanked paper into the carriage 14.

The above-mentioned patent describes the punching operation of displacing material from the sheet material 32 into a carrier member which will transport the stamped segments from the stamping position or punching position shown to the clutch facing position, not shown.

Figure 2:
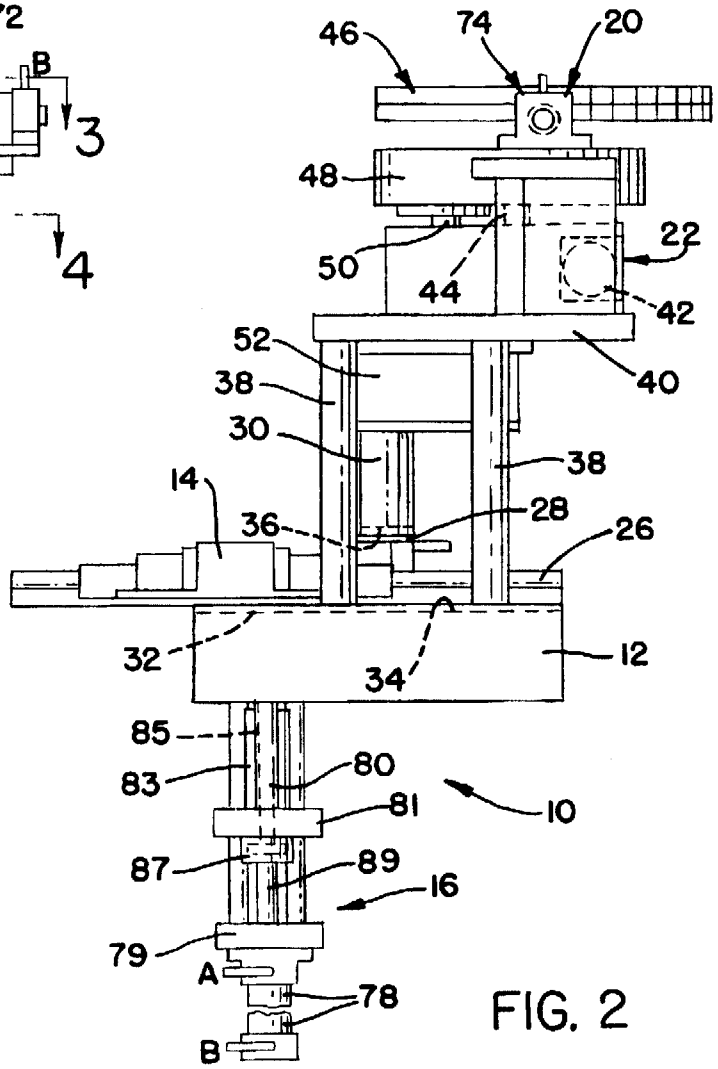
FIG. 2 is a view taken along line 2—2 of FIG. 1.

When the hydraulic pumps 74 and 72 displace fluid through the hydraulic conduits A, the motor 78 is displaced downwardly, as shown in FIGS. 1 and 2, to withdraw the platform 81 from the material 32. After the platform 81 is retracted, the cam 46 is in one of the four dwell cycles 82, and the fluid pressure within the conduits A and B is essentially reduced to atmosphere or raised slightly above atmosphere depending upon the particular system. Also at this time, the carriage 14 is indexed by the Geneva drive 52 to prepare the carriage 14 to receive the next segment to be punched from the material 32. The cycle is repeated by expelling fluid pressure through the hydraulic conduits B to drive the platform 81 upwardly, thereby displacing further material.

Figure 4:
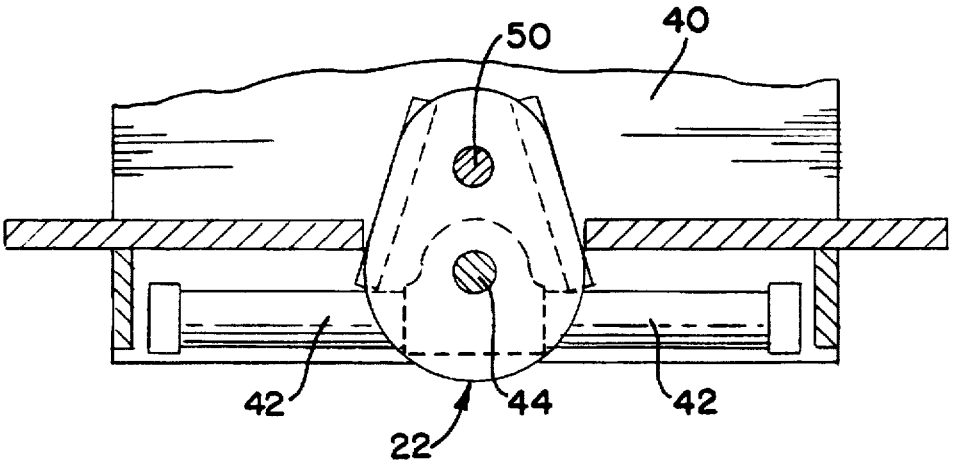
FIG. 4 is a view taken along line 4—4 of FIG. 1.

As the rotary drive is powered by the motors 42 operating from right to left, as seen in FIG. 4, one complete revolution of the cam 46 will occur and four complete revolutions of the shaft 50 will occur. Thus, one clutch facing utilizing quarter circle segments will be stamped or punched into the carriage 14. The carriage will then be moved to expel the clutch facing annulus produced and return to the position shown in FIGS. 1 and 2. At that point, the motors 42 will actuate the rotary drive in the opposite direction which will rotate the cam 46 one full revolution in the opposite direction.

The direction of rotation of the cam 46 is immaterial to the overall operation of this system. In other words, four pumping cycles will occur for one revolution of the cam independent of the direction of rotation as long as one full rotation is undertaken each cycle. Likewise, the direction of rotation of the carriage 14 during the indexing process is also immaterial, as long as the direction of rotation is constant for four consecutive stamped segments.

Figure 5:
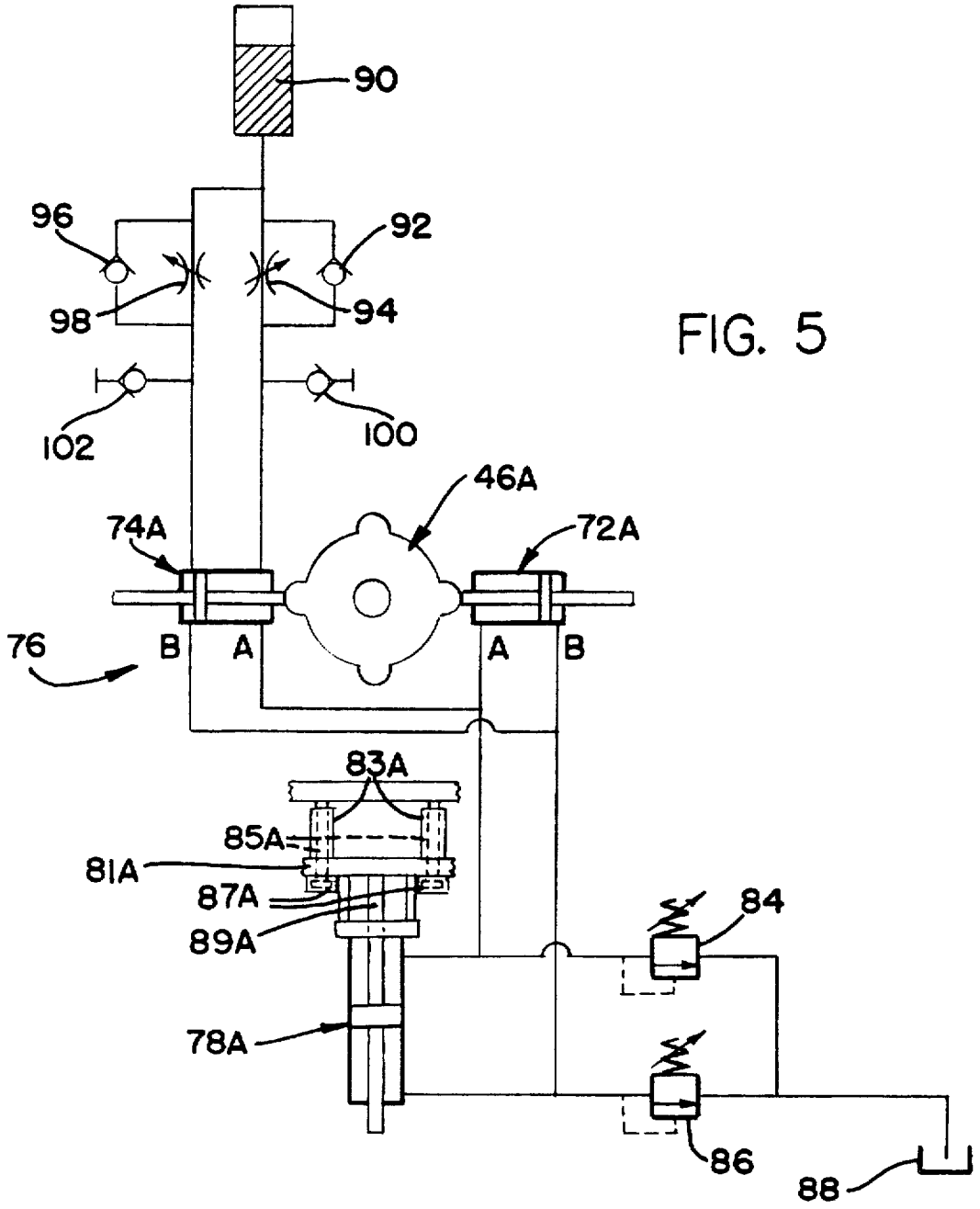
FIG. 5 is a schematic representation of a portion of the hydraulic system utilized in the present invention.

The schematic representation of FIG. 5 provides a representation of a portion of the valve control 76. The units shown schematically in FIG. 5 that are representative of the units described in FIGS. 1 through 4, are given the same numerical designation with A suffix. For example, the cam 46A is shown to provide a rotary drive input resulting in reciprocating outputs of the pumps 72A and 74A. The fluid in passage A and B is distributed to the hydraulic motor 78A which drives the platform 81A and the air spring rods 85A.

The conduit A is also in fluid communication with a system relief valve 84 which prevents the pressure in conduit A from exceeding a predetermined value. The fluid pressure in conduit B is limited by a hydraulic or system relief valve 86 which also limits the maximum system pressure allowable. These valves can be seen at different levels since the downstroke or nonworking stroke of the motor 78A will require less pressure than the upward or punching stroke. It is also desirable to limit the punching stroke pressure so as to not damage the punch should some misalignment occur. Any overage from the valves 84 and 86 is distributed to a common reservoir 88.

A selectively pressurized reservoir 90 is provided to supply fluid pressure to the conduits A and B. The conduit A is in fluid communication with the reservoir through a normally closed check valve 92 and a normally closed adjustable throttle valve 94. The passage B is in fluid communication with the reservoir 90 through a normally closed check valve 96 and a variable throttle valve 98. The reservoir 90 is preferably pressurized by air in a well known manner.

The throttle valves 94 and 98 can be conventional hand operated valves or solenoid operated valves whichever might be desirable for a specific installation. These valves 94 and 98 are used to prefill the system prior to operation of the punches and/or evacuate the system. The system can be prefilled and bled also through a pair of bleed valves 100 and 102.

The check valves 92 and 96 are spring-closed check valves such that a pressure differential of approximately 20 psi between the reservoir 90 and the cylinders of the pumps 74A and 72A is required to permit the valves 92 and 96 to be opened. During the operating cycle in the dwell period, if the fluid level within either of the conduits A or B is decreased, thereby having some void within the system, the pressurized reservoir 90 will provide fluid to overcome the spring load of either of the check valves 92 or 96 to fully fill the conduits A and B to the desired nonoperating or nonworking pressure. That is, the pressure in the system whenever the cam is in a dwell cycle.

As is evident from FIGS. 1 through 4, the hydraulic punch actuating system provides a very compact assembly unit. The position of the cam 46 and power unit 22 is independent of the position of the hydraulic motor 78 and the accompanying punch system. The hydraulic power system permits the vertical alignment of the power unit, the Geneva drive and the carriage drive thereby reducing the overall volume requirement for the machine. The floor space required to place the machine in a production facility is therefore considerably less than what is required by prior art devices.

I claim:

1. Hydraulic actuation apparatus for a punch comprising:

a rotary drive mechanism having a first rotary output rotating at a first speed and a second rotary output rotating at a second speed greater than and an integer multiple of the first speed;

a cam member driven by the first rotary output and having a plurality of lobes equal in number to the integer multiple;

each lobe having a rise and a fall, a dwell portion provided between adjacent lobes;

hydraulic pump means driven by said lobes of said cam member for providing a first hydraulic pressure source in response to the lobe rise and for providing a second hydraulic pressure source in response to the lobe fall;

a punch member having a reciprocal motor with a first power cylinder in fluid communication with the first pressure source to drive the punch in one direction and a second power cylinder in fluid communication with said second pressure source to drive the punch in an opposite direction;

a pressurized fluid reservoir and valve means for supplying make-up hydraulic fluid to the first and second pressure sources during the dwell portion; and pressure relief means for each power cylinder for relieving hydraulic fluid when the pressure therein exceeds a predetermined value.

2. Hydraulic actuation apparatus for a punch comprising:

a rotary drive mechanism comprised of reciprocating hydraulic motors and having a first rotary output rotating at a first speed and a second rotary output rotating at a second speed greater than and an integer multiple of the first speed;

a cam member comprised of a track having an inside face and an outside face, the track having a plurality of lobes on each face equal in number to the integer multiple;

each lobe having a rise and a fall, a dwell portion provided between adjacent lobes;

a plurality of hydraulic pump means reciprocally driven by said lobes of said inside and outside faces, each pump means providing a first hydraulic pressure source in response to the lobe rise and for providing a second hydraulic pressure source in response to the lobe fall;

a punch member having a reciprocal motor with a first power cylinder in fluid communication with the first pressure source of each pump means to drive the punch in one direction and a second power cylinder in fluid communication with said second pressure source of each pump means to drive the punch in an opposite direction;

a pressurized fluid reservoir and valve means for supplying make-up hydraulic fluid to the first and second pressure sources during the dwell portion; and pressure relief means for each power cylinder for relieving hydraulic fluid when the pressure therein exceeds a predetermined value.

3. The hydraulic actuating apparatus defined in claim 2 further comprising:

air spring means for extending the reciprocal travel of the punch member in the one direction beyond the reciprocal travel of the motor.

* * * * *